US005890224A

United States Patent [19]

Clark

[11] Patent Number: 5,890,224

[45] Date of Patent: Apr. 6, 1999

[54] PROTECTIVE GUARD FOR EXTREMITY OF A HUMAN BODY

[76] Inventor: Larry N Clark, 4456 S. Larch Way, Taylorsville, Utah 84123

[21] Appl. No.: 903,478

[22] Filed: Jul. 30, 1997

[51] Int. Cl.[6] ..... A41D 13/00

[52] U.S. Cl. ..... 2/22

[58] Field of Search ..... 2/22, 239, 267, 2/23, 24, 455, 456; 602/5, 7, 23

[56] References Cited

U.S. PATENT DOCUMENTS

| | | | |
|---|---|---|---|
| 1,225,354 | 5/1917 | Pierce | 2/239 |
| 2,785,407 | 3/1957 | Reeder | 2/22 |
| 3,044,075 | 7/1962 | Rawlings | 2/22 |
| 3,189,919 | 6/1965 | Chase | 2/22 |
| 3,621,489 | 11/1971 | Keller | 2/22 |
| 4,001,953 | 1/1977 | Fugere et al. | 2/22 |
| 4,306,315 | 12/1981 | Castiglia | 2/22 |
| 4,669,126 | 6/1987 | Jones | 2/239 |
| 5,405,312 | 4/1995 | Jacobs | 2/22 |
| 5,581,817 | 12/1996 | Hicks | 2/239 |

FOREIGN PATENT DOCUMENTS

| | | | |
|---|---|---|---|
| 2472399 | 7/1991 | France | 2/22 |
| 2743741 | 10/1976 | Germany | 2/22 |
| 3113 | 2/1908 | United Kingdom | 2/22 |
| 9010395 | 9/1990 | WIPO | 2/22 |

*Primary Examiner*—Amy Vanatta
*Attorney, Agent, or Firm*—Terry M. Crellin

[57] ABSTRACT

A protective guard to protect an extremity of a person from blows received during sports related activities comprises an elongate tubular member made of a stretchable fabric material that is received in tubular fashion concentrically over the extremity of the person. The fabric is stretched so that the tubular member conforms snugly around the extremity of the person. A rigid shell is molded so as to conform to the shape of the extremity of the person, with the rigid shell being placed over one end portion of the elongate tubular member so that the end portion of the tubular member is positioned between the extremity of the person and the rigid shell. The second end of the tubular member is pulled back over the rigid shell so as to cover the entire rigid shell and hold the rigid shell firmly in place on the extremity of the person even during rigorous physical activity involving the extremity of the person.

6 Claims, 2 Drawing Sheets

PROTECTIVE GUARD FOR EXTREMITY OF A HUMAN BODY

BACKGROUND OF THE INVENTION

1. Field of the Invention

The present invention relates generally to protective devices or guards that are worn on an extremity of a person to protect the extremity from blows received during sports related activities. In particular, the present invention relates to such protective devices or guards which are custom molded or formed to the shape of the person's extremity on which the device or guard is to be used. The present invention especially relates to devices or guards of the type that are custom molded or formed to the shape of the shin of the person who is going to use the device to guard or protect the shins of the person when the person is participating in a sports activity such as hockey or soccer.

2. State of the Art

Protective guards that wrap at least partially around an extremity of a person and which are used to protect the extremity from blows received during sports related activities are well known in the art. Straps have been used to secure a rigid guard to the person's extremity. For example, U.S. Pat. No. 4,700,406 discloses an adjustable strap that wraps around the guard and the person's extremity. Most participants in a sports related activity such as hockey or soccer find that such straps are objectionable and that further, the straps do a mediocre job of retaining the guard in place during the rigorous action involved in the sports related activity.

To avoid the use of straps, it has been customary for participants in sports such as hockey and soccer to utilize two pair of socks. One pair of socks is worn against the foot and leg of the user, and a second pair of socks is worn over the first pair. A pad or a rigid shell, which is curvilinear so as to wrap around at least the forward portion of the shin of the person is held between the two pair of socks so as to curve around the shin of the person. This technique necessitates the wearing of shoes which are oversized to accommodate the thickness of the double pair of socks over the foot area.

In U.S. Pat. No. 4,669,126 an athletic sock is disclosed having a single foot portion and two leg portions stitched or knitted together so that a shin guard can be worn over the inside sock portion and beneath the outside sock portion. The double pair of athletic socks are however still bulky and uncomfortable, and they do not provide sufficient support for the shin guards. The user has to continually reposition the shin guards after the guards slide downwardly on the leg of the user.

A modified sock-type shin guard is disclosed in U.S. Pat. No. 4,306,315 comprising an elastic generally tubular sock member that tightly surrounds the lower leg of the wearer in the vicinity of the shin. A pocket is provided in the front of the tubular member to receive an elongate substantially rigid member that is tapered toward the lower end thereof to substantially conform to the fibula of the wearer. The rigid member is made of heat formable material, and the rigid member is heat formed to the shin area of the leg of the user before the rigid member is inserted into the pocket in the tubular member. The sock-type shin guard of U.S. Pat. No. 4,306,315 is somewhat awkward to use inasmuch as the sock member must be positioned very precisely prior to the insertion of the rigid member, or the sock member and inserted rigid member must thereafter be moved and adjusted to a proper position.

OBJECTIVES AND BRIEF DESCRIPTION OF THE INVENTION

It is a principal objective of the present invention to provide a protective guard device comprising (1) a simple tubular member that can be pulled on the user's leg or other extremity without requiring precise preset positioning of the tubular member, and (2) a rigid guard member placed on the user's leg or other extremity so that the guard member lies over the upper end portion of the tubular member at a desired position on the user's leg or other extremity, with the lower end portion of the tubular member then being pulled back over the guard member and upper end portion of the tubular member to securely hold the guard member in place against the leg or other extremity of the user.

An additional objective of the present invention is to provide novel means for quickly and easily retaining the rigid guard member securely to the correct position on the user's extremity.

A still further objective of the present invention is to provide a process in which (1) the guard member is heated to an elevated temperature sufficient to allow the guard member to become pliable so that it can be custom formed and molded to shape in-situ on the user's leg, (2) the heated guard member is retained on the user's leg with a substantially uniform force applied over the entire surface of the guard member while the guard member is at an elevated temperature to custom mold the guard member to the exact shape of the user' leg, and (3) the custom molded guard member is held in place until it cools to its rigid condition.

The above objectives are achieved in accordance with the present invention by providing a novel, protective guard to be worn on an extremity of a person to protect the extremity from blows received during sports related activities. The guard of the present invention is preferably made of a heat formable material (as used throughout the specification and claims, the term "heat formable" is meant to mean a material that softens when heated and becomes pliable so that the material can be molded to a desired shape) and can thus be custom molded to fit the exact shape of the extremity of the person.

In addition to the guard, the device of the present invention includes an elastomeric tubular member that is pulled longitudinally and concentrically over the extremity of the user so that the upper end portion of the tubular member covers the portion of the user's extremity that is to be protected by the guard. The protective guard member, which as mentioned previously is preferably made of a heat formable material that can be molded or formed to the contour of the extremity of the user, is pressed against the upper portion of the tubular member and made to at least curve around the surface of the portion of the extremity that is to be protected by the guard.

The lower end portion of the elastomeric tubular member is pulled back over the first end portion of the tubular member and the guard member that is being held in place against the first end portion of the tubular member. The second end portion of the tubular member covers the entire outer surface of the guard member that faces away from the extremity of the user. The second end portion of the elastomeric tubular member firmly holds the guard member securely in place on and around the user's extremity.

The elastomeric or stretchable nature of the tubular member maintains a tight fit of the first end portion of the tubular member on the extremity of the user and holds the first end portion of the tubular member firmly in place on the extremity of the user. The second end portion of the tubular member applies substantially uniform pressure or force over the entire outer surface of the guard member so as to hold the guard member securely in place against the user's extremity. In addition, the second end portion of the tubular member supplements the tight fit of the first end portion of the tubular method to insure that the first end portion of the tubular member is held firmly on the extremity of the user so that the tubular member and the contained guard member will not move either back and forth or up and down on the extremity.

As mentioned previously, the guard member is preferably made of a heat formable material and prior to being pressed against the extremity of the user, the guard member is heated sufficiently to become pliable and capable of being formed and shaped about the surface of the user's extremity. When pressed against the user's extremity, the guard is curved and formed around the extremity, with the second end portion of the tubular member then being pulled up over the guard so as to cover the entire outer surface of the guard. When pulled over the guard, the second end portion applies a substantially uniform pressure or force on the pliable guard member so that the guard member is custom molded or shaped to the exact surface contour of the user's extremity. The custom molded guard assumes substantially the exact surface contour of the user's extremity, and the second end portion of the tubular member holds the custom formed guard securely in place while the guard cools and becomes rigid.

Once the guard has become rigid, it can be left in place covered by the second end portion of the tubular member while the user participates in sports related activities such as hockey and soccer. The tubular member is held firmly in place on the user's extremity by the combined tight fit of the tubular member on the user's extremity. This tight fit is achieved through the elasticity of the first end portion of the tubular member as well as the added action of the elasticity of the second end portion of the tubular member that is pulled back over the first end portion. The guard is held in an immovable, secure position on the extremity of the user by the action of the tight fit of the folded back second end portion of the tubular member. In addition, the second end portion of the tubular member is pulled sufficiently that the fold between the first end portion and the second end portion lies immediately along and in contact with the lower edge of the guard. The guard is held tightly in place against the extremity of the user by the combined action of the tightness of the second end portion of the tubular member that covers the entire guard and the support at the lower edge of the guard provided by the fold between the first and second end portions of the tubular member. The guard of the present invention remains securely in its proper position even under the most strenuous and rapid motions of the user's extremity experienced when participating in such athletic activities like hockey and soccer. The guard remains securely in its proper position, and the user never needs to adjust the position of the guard during the entire period of time in which the user participates in the athletic activity.

Following any period of athletic activity, the guard is easily removed by pulling the second end portion of the tubular member away from the guard so that the guard is free to be removed from the extremity of the user. The entire tubular member is then pulled from the user's extremity. When the guard is to be used again, the tubular member is pulled over the user's extremity, the guard is position on the user's extremity in its proper position against the first end portion of the tubular member, and the second end portion of the tubular member is pulled back over the first end portion and over the guard that is positioned on the first end portion.

Although it is not necessary to reform, i.e., remold or reshape the guard every time it is used, it is to be recognized that the guard can be heated and reformed or remolded during any subsequent use of the device of the present invention. It should be further recognized that the guard need not be a custom made guard that is molded to the exact contour of the extremity of the user. The guard could be a preformed, standardized guard that has the general contour of the extremity of the user. Of course, when using a preformed guard, the benefits of a custom formed guard are not achieved, but the preformed, standardized guard is held securely in place by the turned back tubular member of the present invention. The preformed guard will not move on the extremity of the user, and there is never any adjustment to the guard required during the entire time that the user is participating in the athletic activity.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
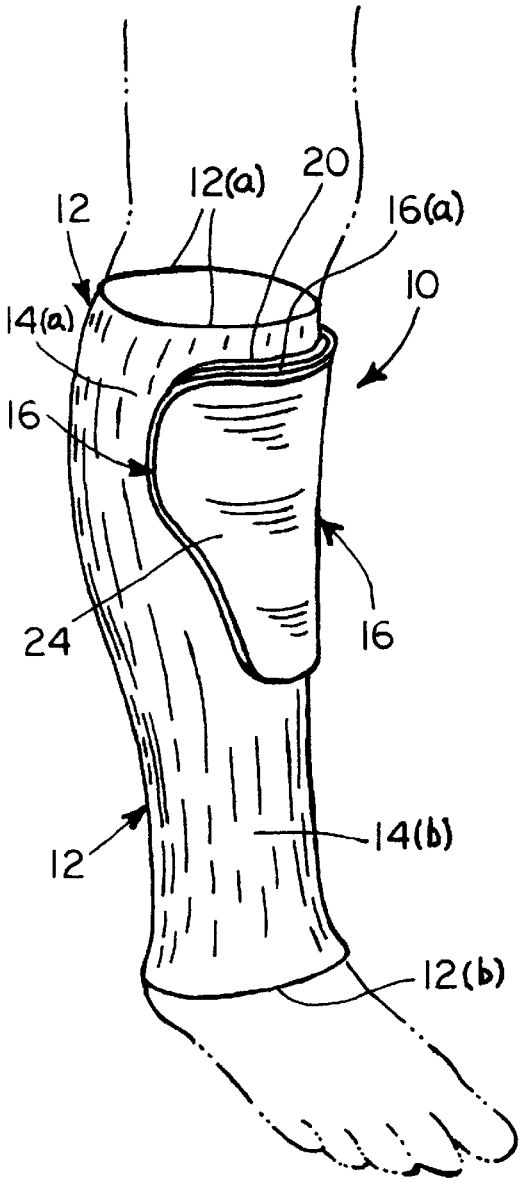
FIG. 1 is a pictorial representation of a shin guard device in accordance with the present invention, with the device being shown in its partially assembled condition on the leg of a user of the device.

Referring now to the drawings, a protective guard device 10 in accordance with the present invention is shown to be worn on an extremity, as shown, a lower leg of a person, to protect the extremity from blows received during sports related activities such as hockey and soccer. The protective guard device 10 comprises an elongate tubular member 12 that is made of a stretchable fabric material. Preferably, the tubular member 12 is made from an elastomeric material or spandex material which is in turn made from elastomeric textile fibers which are marketed under the trademark Lycra by the DuPont Company of Wilmington, Del. The elongate tubular member 12 is received in tubular fashion concentrically over the extremity, i.e., the lower leg of the person, with the stretchable fabric being stretched so that the tubular member conforms snugly around the extremity, i.e., lower leg, of the person.

Figure 6:
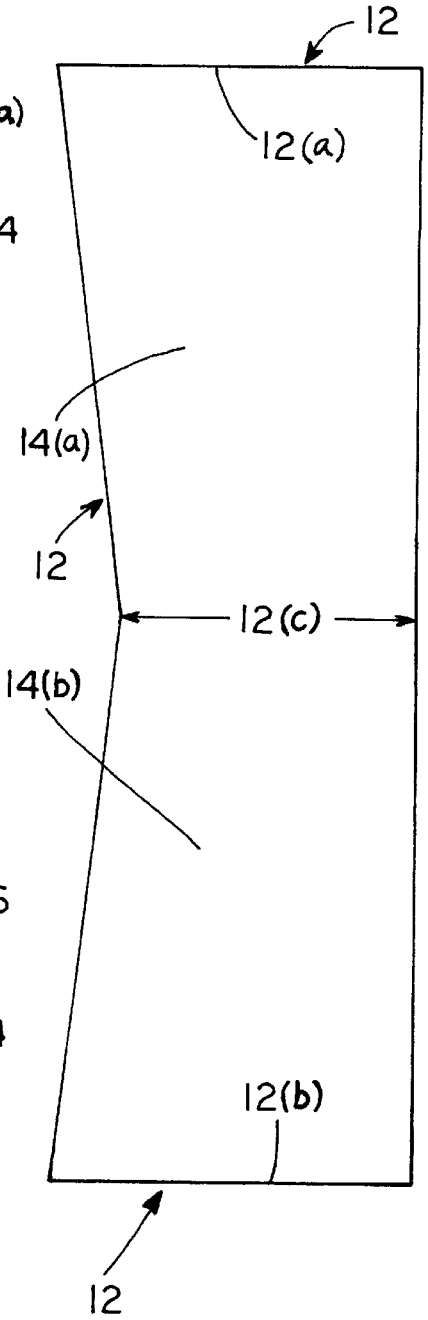
FIG. 6 is a side view of a preferred embodiment of a tubular member for the device of the present invention, with the tubular member being shown in its flattened, elongate form.

A preferred embodiment of the tubular member 12 is shown in a flattened condition in FIG. 6. As can be seen from FIG. 6, when the tubular member 12 is laid flat, the opposite ends 12(*a*) and 12(*b*) have a greater width than the width of the mid-section at the center portion 12(*c*) of the tubular member 12. In essence, the tubular member 12 is larger in cross section at its opposite ends that it is at its midsection. The actual size of the diameter of the tubular member 12 is such that when the tubular member is pulled on the extremity of the user, the elastomeric material of the tubular member must be stretched so that the tubular member fits tightly on the extremity of the person. The advantage of the shape of the tubular member 12 as shown in FIG. 6 will be described more fully hereinafter.

Figure 2:
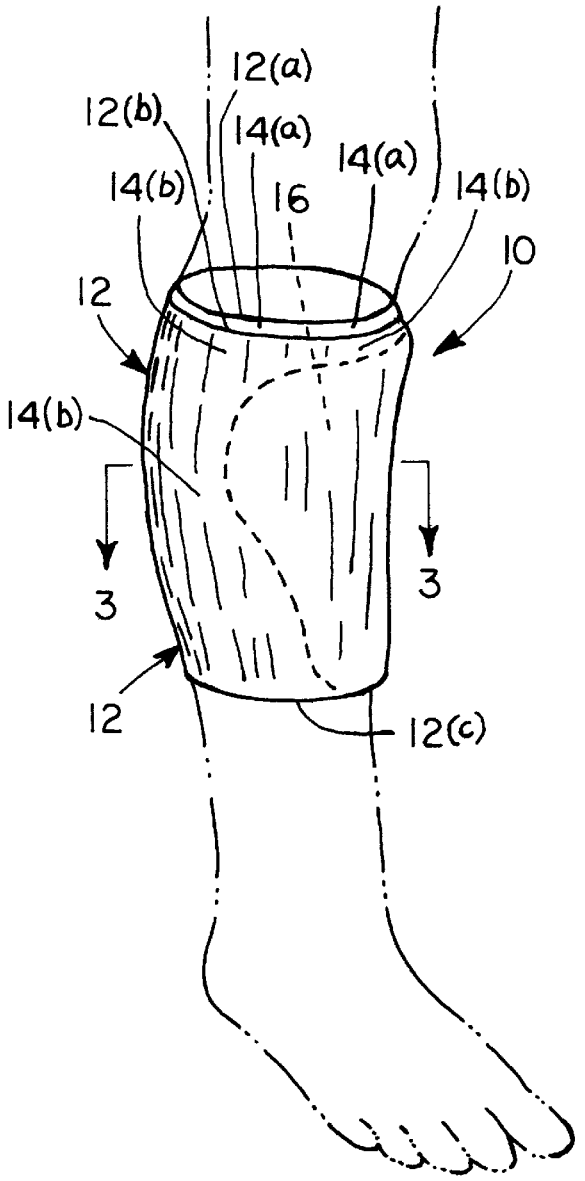
FIG. 2 is a pictorial view similar to that of FIG. 1 but showing the shin guard device in its fully operable, assembled condition.
Figure 3:
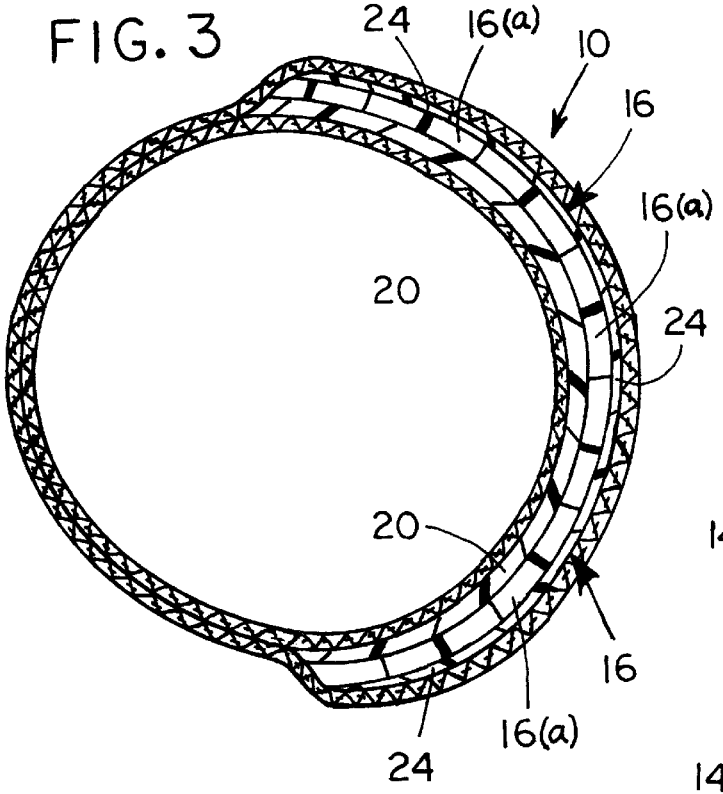
FIG. 3 is a cross-sectional view of the shin guard of FIG. 2 taken along line 3—3 of FIG. 2, with the user's leg being omitted.

A rigid shell 16 is molded so as to conform to the shape or contour of the extremity of the person. As shown in FIGS. 1 and 2, the rigid shell 16 is formed to fit around the shin of the user and is placed over one end portion 14(*a*) of the elongate tubular member 12 so that the one end portion 14(*a*) of the elongate tubular member 12 is positioned between the extremity, i.e., the leg, of the person and the rigid shell 16. The shell 16 is advantageously formed from a layer of polymeric material such as polypropylene. In a preferred embodiment of the invention as will be discussed hereinafter, the shell 16 is formed of a heat formable polymeric material.

As shown in FIG. 1 of the drawings, the device 10 of the invention is illustrated in its partially assembled condition. The rigid shell 16 must be held manually in its position as shown in FIG. 1. The fully assembled device 10 is shown in FIG. 2 of the drawings. In the fully assembled condition, the second end portion of the elongate tubular member 12 is pulled back over the rigid shell 16 so as to cover the entire rigid shell 16 and hold the rigid shell 16 firmly in place on the extremity, i.e., the lower leg, of the person even during rigorous physical activity involving the extremity of the person.

As mentioned previously, the tubular member 12 has a diameter such that the tubular member 12 must be stretched to fit over the extremity of the user. In this way, the elastomeric material of the tubular member 12 fits tightly in stretched condition over the extremity. It is very advantageous, if the tubular member 12 exerts a substantially uniform pressure on the extremity, with the force or pressure at one portion of the tubular member 12 not being significantly greater or lesser than any other portion of the tubular member 12. The shape of the tubular member 12 as shown in FIG. 6 is very advantageous in providing such uniform pressure on the extremity of the person.

Generally, the extremity of a person, whether it be an arm or a leg, varies in size along the length of the extremity. When the device 10 of the present invention is used to protect the shin of a leg of a person the portion of the leg near the knee is larger than the portion of the leg near the ankle. To accommodate this difference in size, the tubular member 12 is made as shown in FIG. 6 and described above. One end of the tubular member 12 is pulled over the leg and up to the knee or very close to the knee. The rigid shell 16 is then placed around the shin and against the upper portion 14(*a*) of the tubular member 12 as shown in FIG. 1. The lower portion 14(*b*) of the tubular member 12 is then pulled upwardly over the upper portion 14(*a*) and over the rigid shell 16 to result in the completed device as shown in FIG. 2. Now, the advantage of the preferred shape of the tubular member 12 of FIG. 6 can be understood. The two opposite ends 12(*a*) and 12(*b*) of the tubular member 12 end up adjacent each other and very near the knee. The center portion 12(*c*) forms a fold that closes the bottom of the device 10. The portion of the leg near the folded center portion 12(*c*) is smaller than the portion of the leg near the knee. The smaller center portion 12(*c*) is stretched nearly the same as the larger end portions. This allows a substantially uniform pressure over the leg at all portions of the tubular member 12.

In a preferred embodiment of the protective guard device 10 in accordance with the present invention, the rigid shell 16 comprises a layer 16(*a*) of heat formable polymeric material that is formed to the contour of the extremity of the person. Any of the well known heat formable rigid plastic orthopedic sheets presently available in commerce can be used. One such material is the plastic sheet material disclosed in U.S. Pat. No. 3,906,943, the entire contents of which are incorporated herein by reference.

The plastic material may be used alone. However, in an especially preferred embodiment of the present invention an inner layer 20 of resilient foamed polymeric material is securely adhered to an inner surface of the layer of heat formable plastic material so that the layer 20 of resilient foamed polymeric material faces the extremity of the person when the rigid shell 16 is placed over the extremity and in contact with the one end portion 14(*a*) of the elongate tubular member 12.

The rigid shell 16 further advantageously comprises a sheet 24 of polymeric film adhered to an outer surface of the layer of heat formable polymeric material forming the rigid shell 16. The sheet 24 of polymeric film forms a tough outer surface over the outer surface of the layer of heat formable polymeric material forming the rigid shell 16. The sheet 24 is advantageously made of vinyl polymeric materials.

In a preferred embodiment of the invention, a protective guard device 10 is custom molded to the extremity of the person that is to use the device. The rigid shell is custom molded in-situ on the extremity of the person by heating the rigid shell, or the flat composite member that will be formed into the rigid shell, so that the layer of heat formable polymeric material is heated to a temperature at which it is pliable and capable of being molded to a desired shape around the extremity of the person. The rigid shell 16 is initially formed as a substantially flat composite member that is cut to a desired shape. The flat composite member comprises the layer of heat formable polymeric material, the layer of foamed polymeric material adhered to one broad face of the layer of heat formable polymeric material, and the sheet of polymeric film that is adhered to the other broad face of the layer of heat formable polymeric material.

The rigid shell, or the flat composite precursor thereof, is placed on the one end portion 14(*a*) of the elongate tubular member 12 and the heated layer of heat formable polymeric material is pressed around the extremity of the person to form the layer of heat formable polymeric material into a contoured shape around the extremity of the person. The second end portion 14(*b*) of the elongate tubular member 12 is then pulled back over the shell 16 comprising the heated layer of heat formable polymeric material so that the second end portion 14 (*b*) of the elongate tubular member 12 exerts a substantially uniform pressure on the heated layer of heat formable polymeric material, whereby the heated layer of heat formable polymeric material assumes a custom-formed shape corresponding directly to the extremity of the person.

The heated layer of heat formable polymeric material is then allowed to cool and become rigid while the elongate tubular material 12 simultaneously overlies and exerts a substantially uniform pressure thereon.

Figure 5:
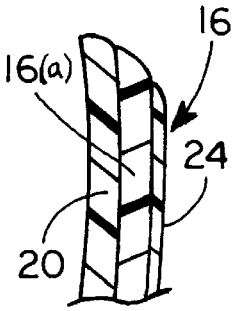
FIG. 5 is a cross-sectional view through a representative side edge of the rigid guard member of FIG. 4 taken along line 5—5 of FIG. 4.
Figure 4:
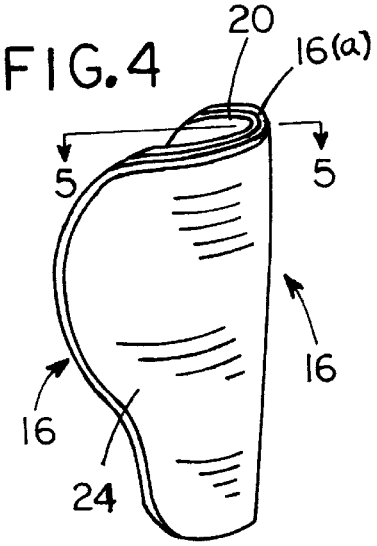
FIG. 4 is a pictorial view of a rigid guard member of the shin guard device of FIGS. 1 and 2.

It is advantageous to use a shell 16 that is initially formed as a flat member comprising the layer of heat formable polymeric material, the layer of foamed polymeric material, and the sheet of polymeric film. Then, when the second end portion 14(*b*) of the tubular member 12 is pulled back over the shell 16, the tubular member 12 exerts a substantially uniform pressure on the shell 16, including the side edges of the shell 16. As is best shown in FIG. 5, the combined action of the bending of the lamina of the shell 16 and the uniform pressure of the tubular member 12 produces a curved, smooth side edge on the shell. This curved, smooth side edge has been found to be very comfortable to the user when the device 10 of the present invention is being worn by the user.

Although a preferred embodiment of the protective guard device of the present invention has been illustrated and described, it is to be understood that the present disclosure is made by way of example and that various other embodiments are possible without departing from the subject matter coming within the scope of the following claims, which subject matter is regarded as the invention.

I claim:

1. A protective guard to be worn on an extremity of a person to protect the extremity from blows received during sports related activities, said protective guard comprising an elongate tubular member made of a stretchable fabric material that is received in tubular fashion concentrically over the extremity of the person, with said stretchable fabric being stretched so that said tubular member conforms snugly around the extremity of the person;

a rigid shell molded so as to conform to the shape of the extremity of the person, said rigid shell being placed over an upper end portion of said elongate tubular member so that said upper end portion of said elongate tubular member is positioned between the extremity of the person and said rigid shell;

said second end of said elongate tubular member is pulled back over said rigid shell so as to cover the entire rigid shell and form a fold, with the fold in turn forming a closed bottom for the first and second ends of said elongate tubular member;

said fold being positioned at a lower end of said rigid shell so that said rigid shell is held firmly in place on the extremity of the person and supported by said fold so that said rigid shell is held firmly in place even during rigorous physical activity involving the extremity of the person.

2. A protective guard in accordance with claim 1 wherein said stretchable fabric material is made from elastomeric textile fibers.

3. A protective guard in accordance with claim 2 wherein said rigid shell comprises a layer of heat formable polymeric material that is formed to the contour of the extremity of the person; and an inner layer of resilient foamed polymeric material that is securely adhered to an inner surface of said layer of heat formable polymeric material so that said layer of resilient foamed polymeric material faces the extremity of the person when said rigid shell is placed over said one end portion of said elongate tubular member.

4. A protective guard in accordance with claim 3 wherein said rigid shell further comprises a sheet of polymeric film adhered to an outer surface of said layer of heat formable polymeric material so that said sheet of polymeric film forms a tough outer surface over the outer surface of said layer of heat formable polymeric material.

5. A protective guard in accordance with claim 4 wherein the rigid shell is custom molded to the extremity of the person by heating said layer of heat formable polymeric material to a temperature at which it is pliable and capable of being molded to a desired shape around the extremity of the person;

pressing the heated layer of heat formable polymeric material against the one end portion of said elongate tubular member and around the extremity of the person to form said layer of heat formable polymeric material into a contoured shape around the extremity of the person;

pulling said second end portion of said elongate tubular member back over said heated layer of heat formable polymeric material so that said second end portion of said elongate tubular member exerts a substantially uniform pressure on said heated layer of heat formable polymeric material whereby said heated layer of heat formable polymeric material (1) assumes a custom-formed shape corresponding directly to the extremity of the person and (2) bending of lamina formed by said inner layer of foamed polymeric material, said layer of heat formable polymeric material and said sheet of polymeric film so as to produce a curved, smooth side edge on said shell; and allowing the heated layer of heat formable polymeric material to cool and become rigid while said elongate tubular material overlies and exerts a substantially uniform pressure thereon.

6. A protective guard in accordance with claim 3 wherein the rigid shell is custom molded to the extremity of the person by heating said layer of heat formable polymeric material to a temperature at which it is pliable and capable of being molded to a desired shape around the extremity of the person;

pressing the heated layer of heat formable polymeric material against the one end portion of said elongate tubular member and around the extremity of the person to form said layer of heat formable polymeric material into a contoured shape around the extremity of the person;

pulling said second end portion of said elongate tubular member back over said heated layer of heat formable polymeric material so that said second end portion of said elongate tubular member exerts a substantially uniform pressure on said heated layer of heat formable polymeric material whereby said heated layer of heat formable polymeric material (1) assumes a custom-formed shape corresponding directly to the extremity of the person and (2) bending of lamina formed by said inner layer of foamed polymeric material and said layer of heat formable polymeric material so as to produce a curved, smooth side edge on said shell; and allowing the heated layer of heat formable polymeric material to cool and become rigid while said elongate tubular material overlies and exerts a substantially uniform pressure thereon.

* * * * *